US005088511A

United States Patent [19]

Bain

[11] Patent Number: 5,088,511

[45] Date of Patent: * Feb. 18, 1992

[54] APPARATUS FOR PROTECTING CEILING WORK AREA FROM DISPERSAL OF ASBESTOS FIBERS

[76] Inventor: G. William Bain, 35860 Ashton Pl., Fremont, Calif. 94536

[ * ] Notice: The portion of the term of this patent subsequent to Mar. 27, 2007 has been disclaimed.

[21] Appl. No.: 620,531

[22] Filed: Nov. 28, 1990

Related U.S. Application Data

[63] Continuation-in-part of Ser. No. 462,599, Jan. 9, 1990, Pat. No. 5,024,246, which is a continuation of Ser. No. 337,140, Apr. 12, 1989, Pat. No. 4,911,191.

[51] Int. Cl.[5] ..... B08B 7/04

[52] U.S. Cl. ..... 134/200; 52/DIG. 2; 55/385.2; 134/201; 135/900; 312/1; 454/55

[58] Field of Search ..... 134/104.3, 200, 201; 55/385.2, DIG. 2, DIG. 29; 135/900, 117; 52/63, DIG. 12; 98/115.4; 312/1; 600/21, 22; 15/300.1, 301, 310, 314

[56] References Cited

U.S. PATENT DOCUMENTS

| | | | |
|---|---|---|---|
| 2,473,033 | 6/1949 | Letac | 600/21 |
| 4,067,346 | 1/1978 | Husted | 135/4 |
| 4,108,509 | 8/1978 | Piet et al. | 312/1 |
| 4,335,712 | 6/1982 | Trexler | 128/1 |
| 4,482,347 | 6/1984 | Jacobson | 312/1 |
| 4,505,190 | 3/1985 | Fink et al. | 98/115 |
| 4,626,291 | 12/1986 | Natale | 134/21 |
| 4,633,899 | 1/1987 | Lord | 52/DIG. 12 |
| 4,682,448 | 7/1987 | Healey | 52/63 |
| 4,765,352 | 8/1988 | Streiter | 134/99 |
| 4,809,391 | 3/1989 | Soldatovic | 312/1 X |
| 4,820,000 | 4/1989 | Jacobson | 312/1 |

*Primary Examiner*—Philip R. Coe
*Attorney, Agent, or Firm*—Schapp and Hatch

[57] ABSTRACT

A containment apparatus for confining asbestos fibers and the like floating in the air adjacent to a ceiling work area as a consequence of removing or repairing asbestos containing ceiling material. A substantially fiber-tight bag of flexible material has an open top adapted for positioning in close proximity to a friable ceiling substrate, or for fitting tightly against a stable ceiling substrate, in surrounding relation to the ceiling area to be worked upon and is supported in such position by an apparatus which in turn rests on the floor beneath the ceiling. One or more gloves of flexible material are sealed to openings in the bag, and each glove is adapted for providing protected access to the interior of the bag for the hand and arm of a user. At least a major portion of the bag is substantially transparent so that a user having one or both hands inserted in the gloves can view the area of the ceiling being worked upon from outside the bag. A sub-atmospheric condition is maintained within the bag to prevent unwanted escape of asbestos fibers.

3 Claims, 4 Drawing Sheets

APPARATUS FOR PROTECTING CEILING WORK AREA FROM DISPERSAL OF ASBESTOS FIBERS

This application is a continuation-in-part of copending U.S. application, Ser. No. 07/462,599, filed Jan. 9, 1990 now U.S. Pat. No. 5,024,246, which is a continuation of U.S. application Ser. No. 07/337,140, filed now U.S. Pat. No. 4,911,191.

BACKGROUND OF THE INVENTION

1. Field of the Invention

This invention relates to devices for confining and preventing escape of asbestos fibers and the like during removal or repair of ceiling materials, and more particularly to a containment device having inwardly extending gloves into which the user can thrust his hands and arms to work upon the ceiling area surrounded by the containment device.

2. Description of the Prior Art

It has been found recently that fine asbestos fibers floating in the air are very hazardous in that such fibers are drawn into the lungs of persons breathing the air and can eventually cause lung cancer. For a number of years, ceilings often have been made with asbestos containing materials. Since the discovery of the cancer-causing propensities of asbestos fibers, an enormous effort is being made to eliminate sources of asbestos fiber pollution of the air. In the case of ceilings, a heavy coat of paint has been found to reduce greatly the number of asbestos fibers entrained in the air. In other situations, it has been found necessary to remove the asbestos-laden materials from the ceilings. Also, when it becomes necessary to make repairs to a ceiling having asbestos containing materials, it is essential to prevent release and scattering of asbestos fibers into the surrounding air. Efforts have been made to confine asbestos fibers being emitted from asbestos carrying materials being worked upon. For example, U.S. Pat. No. 4,626,291 to Thomas Natale discloses a containment bag system specifically adapted for the removal of asbestos insulation from asbestos covered pipes and valves without contamination of the worker or the surrounding environment. The containment bag is formed of flexible transparent plastic and is shaped to fit over and enclose a section of pipe being worked upon, the pipe passing through openings near the upper end of the containment bag. A pair of flexible gloves are sealed to a pair of openings in the containment bag and serve to protect the hands and arms of a worker standing outside of the containment bag and working upon a pipe or valve within the bag. The Natale containment bag system is not adapted for use with a ceiling area being worked upon.

U.S. Pat. No. 4,765,352 discloses a sealed portable isolation enclosure for use in removing asbestos material from the ceiling. The worker stands within this booth, and it is necessary to equip the worker with a filter mask and protective clothing because he is working in an extremely contaminated environment.

Other patents showing various containment enclosures not adapted for use with ceilings are listed as follows:

| Patent No. | Inventor | Issue Date |
|---|---|---|
| 4,067,346 | G. Husted | 01/10/78 |
| 4,108,509 | M. Piet et al. | 08/22/78 |

-continued

| Patent No. | Inventor | Issue Date |
|---|---|---|
| 4,335,712 | P. Trexler | 06/22/82 |
| 4,505,190 | C. Fink et al. | 03/19/85 |
| 4,682,448 | B. Healey | 07/27/87 |

The above-listed patents are believed to be relevant to the present invention because they were adduced by a prior art search made by an independent searcher, and a copy of each of the above-listed patents was supplied to the Patent and Trademark Office herebefore.

The term "prior art" as used herein or in any statement made by or on behalf of the applicant means only that any document or thing referred to as prior art bears, directly or inferentially, a date which is earlier than the effective date of this application.

No representation nor admission is made that any of the above-listed documents is part of the prior art in any acceptation of that term, or that no more pertinent information exists.

SUMMARY OF THE INVENTION

The present invention provides a containment for asbestos fibers and the like floating in the air adjacent to a ceiling work area as a consequence of removing or repairing asbestos containing ceiling material. A substantially fiber-tight bag of flexible material has an open top adapted for placement in close proximity to a ceiling surface in surrounding relation to the ceiling area to be worked upon.

The containment bag is supported in the desired position by an apparatus supported on the floor beneath the ceiling. One or more gloves of flexible material are sealed to openings through the containment bag, and each glove is adapted for providing protected access to the interior of the bag for the hands and arms of the users. At least a major portion of the bag is substantially transparent so that users having one or both hands inserted in the gloves can view the area of the ceiling being worked upon from outside the bag. Preferably, the entire bag is formed of transparent, flexible sheet plastic for maximum visibility.

Evacuation means is connected through a flexible hose to the containment bag and is formed for creating a lower than atmospheric pressure condition in the bag. Any leakage through the bag or the seam between the upper edge of the bag and the ceiling is into the interior of the bag, thus effectively preventing the asbestos fibers from floating out into the surrounding atmosphere. The evacuation means is carried upon the support apparatus for the containment bag and is power-driven so that the negative pressure will be maintained within the bag at all times. The evacuation means is provided with a filter capable of removing the asbestos fibers from the air before such air is discharged into the surrounding environment.

The support means for the containment bag is mounted on wheels for precise lateral positioning of the unit under the proposed work area in the ceiling. The support means provides a telescoping generally vertical standard having a horizontally extending rack on its upper end formed for receiving the upper edge of the flexible bag and holding the bag open. Pulley means is provided on the support apparatus for extending and contracting the telescoping standard vertically so as to move the rack toward and away from the ceiling, and for precisely positioning the rack and open top of the bag in close proximity to the ceiling in the desired location so as to maximize the negative pressure effect within the bag.

For stability, the vertical standard is provided with a pair of laterally extending and angularly spaced outrigger frames having floor engaging members at their outer ends. The proportions are such that the apparatus is stable and self-supporting in the desired positions.

Preferably, the outrigger frames and the rack are formed to fold flat for ease in maneuvering and storing the unit. The sealing effect of the open top of the bag against escape of asbestos fibers is enhanced by flexible, semi-tubular resilient members at least partially encircling the horizontal members of the rack and extending therealong, these resilient members also serving to effect a cushioning action if the bag is pressed against the ceiling, and to prevent the bag from being torn by the metallic frame of the apparatus.

In order to assist in reducing the amount of asbestos fibers flying around in the air within the containment bag, a liquid reservoir tank is mounted on the standard, and a manually operable stirrup pump in the reservoir tank is connected by a flexible tube to the interior of the bag. A manually operable spray gun is attached to the discharge end of the flexible tube, and at least the spray tip of the gun is placed within the containment bag.

When the rack supported bag is oversize to cover a larger ceiling area and to accomodate more than one worker at a time, the extra weight is further supported on a plurality of auxiliary legs extending from the rack to the floor. Swivel mounted floor engaging lockable wheels are carried at the lower ends of the auxiliary legs.

It is therefore a principal object of the present invention to provide a highly portable containment for asbestos fibers and the like floating in the air adjacent to a ceiling as a consequence of removing or repairing asbestos containing ceiling materials (ACM), and thus to keep workers from having to work inside an asbestos-contaminated area.

Another object of the present invention is to provide a stable containment of the character described which is capable of fitting in close proximity to a ceiling and in surrounding relation to the ceiling area to be worked upon.

A further object of the present invention is to provide an apparatus for confining asbestos fibers and the like floating in the air adjacent to a ceiling work area as a consequence of removing or repairing ACM from ceiling and the like, and in which the interior of the containment bag is constantly maintained at a sub-atmospheric pressure relative to the surrounding environment.

A still further object of the present invention is to provide an apparatus of the character described wherein the arms and hands of a worker or workers performing operations within the containment bag are protected, and the openings through which the hands and arms are inserted are sealed against loss of asbestos fibers from the containment bag whether occupied are not.

Another object of the present invention is to provide an apparatus of the character described in which the containment bag is supported on the floor beneath the ceiling by a vertically extendable stable apparatus, and the apparatus is adapted for precise lateral positioning of the unit.

Other objects and features of advantage will become apparent as the specification progresses and from the claims.

Figure 1:
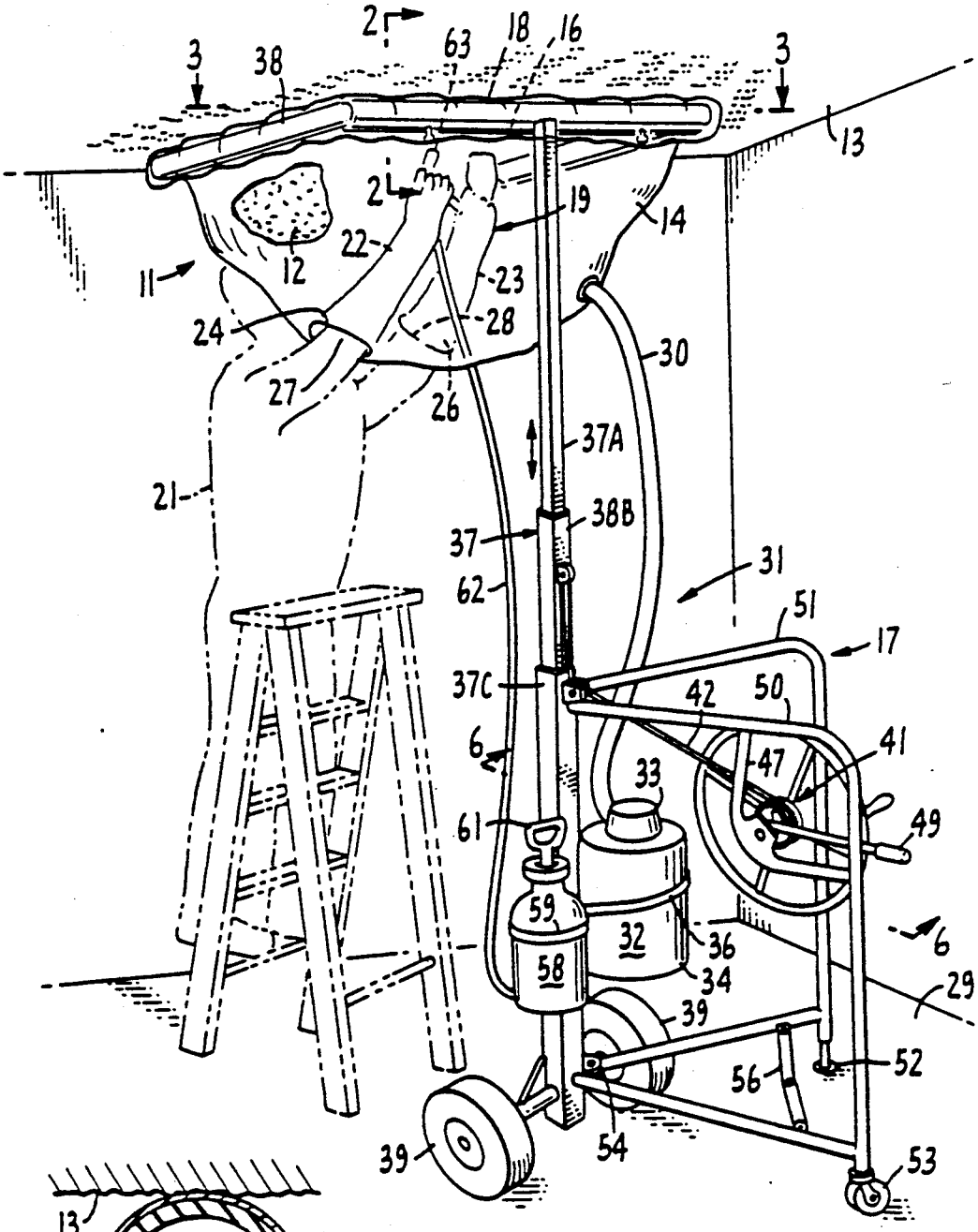
FIG. 1 is a perspective view of an apparatus for confining asbestos fibers and the like floating in the air adjacent to a ceiling as a consequence of removing or repairing ceiling materials.

While only the preferred forms of the invention are illustrated in the drawings, it will be apparent that various modifications could be made without departing from the ambit of the claims.

DESCRIPTION OF THE PREFERRED EMBODIMENTS

As may be seen in the accompanying drawings, the apparatus of the present invention provides a containment 11 for asbestos fibers and the like 12 floating in the air adjacent to a ceiling 13 as a consequence of removing or repairing asbestos-containing materials (ACM) at or near the ceiling 13. The containment 11 provides a substantially fiber-tight bag 14 of flexible material having an open top 16 adapted for placement in close proximity to the ceiling 13, or in a position fitting against the ceiling, in surrounding relation to the ceiling area 15 to be worked upon, support means 17 formed for removably holding the bag 14 in the desired position relative to the ceiling 13, and glove means 19 of flexible material sealed to the bag 14 and adapted for providing protected access to the interior of the bag for the hands and arms of users 21.

In accordance with the present invention, a major portion of the bag 14 is substantially transparent so that a user 21 having a hand or hands inserted into the glove means 19 can view the area of the ceiling being worked upon from outside the bag 14. Preferably, bag 14 is formed of transparent flexible sheet plastic which is substantially impermeable to asbestos fibers and the like.

Figure 3:
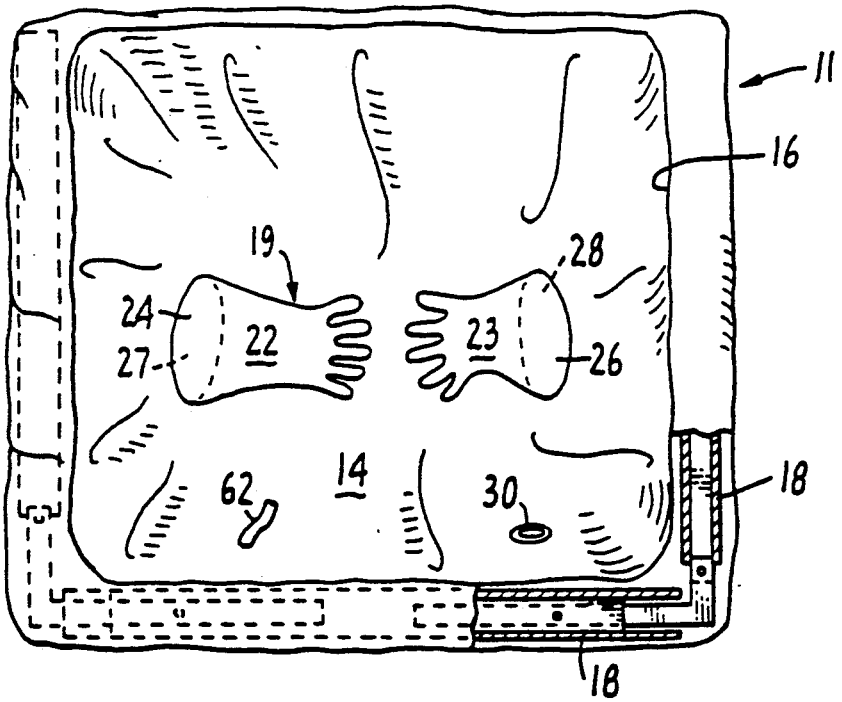
FIG. 3 is an enlarged plan view taken substantially on the plane of line 3—3 of FIG. 1, with portions broken away and shown in section to reveal internal detail.

In the apparatus shown in FIGS. 1 and 3, the glove means 19 is provided in the form of a pair of flexible gloves 22 and 23 sealed at their cuffs 24 and 26 to openings 27 and 28 in the bag, with each pair of the gloves being positioned and arranged to accommodate both hands of a user 21 in comfortable position for working on the area of the ceiling isolated by the containment bag 14. Preferably the material of the gloves 22 and 23 is a thin, flexible plastic, although it should be apparent that other conventional glove materials relatively impermeable to asbestos fibers can be used.

As may best he seen in FIG. 1 of the drawings, the support means 17 is adapted for resting on a floor 29 below the ceiling 13 and is formed for supporting the containment bag 14 at desired elevations above the floor 29. Height regulating means 31 on the support means 17 is provided for moving the bag 14 toward and away from the ceiling 13.

As a feature of the invention, evacuation means 32 is connected to the bag 14 and is adapted for creating a much lower than atmospheric (sub-atmospheric) pressure condition in such bag to limit leakage of asbestos fibers from the area confined by bag 14. The evacuation means 32 includes a motor driven exhaust fan and filter 33 mounted in a housing 34 which, in turn, is removably carried by a member 36 on the support means 17.

As here shown, the support means 17 provides a telescoping substantially vertical standard 37 having a horizontally extending rectangular rack 38 on its upper end formed for receiving the upper edge of the bag 14 and holding the open top 16 of bag 14 in spread condition to surround the work area.

Preferably, the support means 17 is mounted on wheels 39 for easy movement and precise positioning of the apparatus with the open end 16 of the bag vertically aligned with the work area on the ceiling 13. Pulley means 41 is provided on the support means 17 and is formed for extending and retracting the telescoping standard 37 vertically so as to move the rack 38 toward and away from the ceiling 13.

Figure 6:
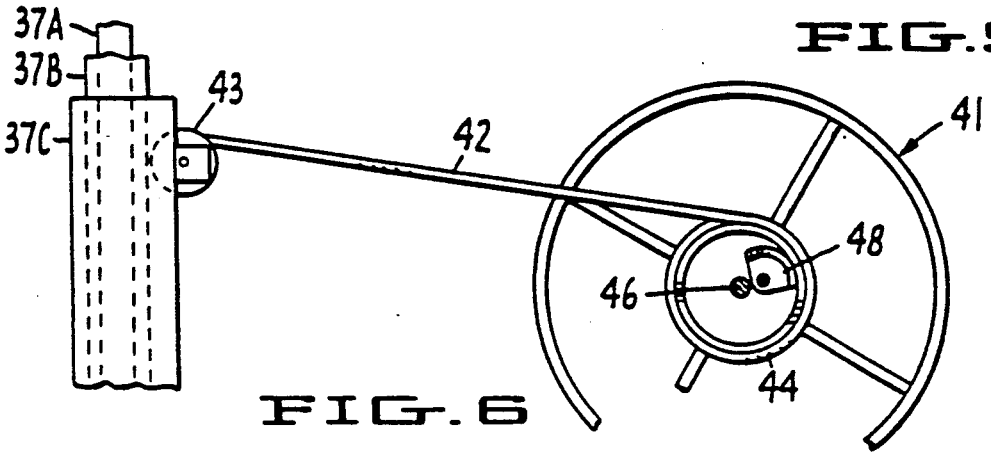
FIG. 6 is an enlarged fragmentary detail view of a pulley operated device for raising and lowering portions of the apparatus.

As may best be seen in FIGS. 1 and 6 of the drawings, the vertioal standard 37 is in the form of three telescoping sections 37A, 37B and 37C. A cable 42 is connected at one end to the bottom end of section 37A and is entrained over a pulley wheel 43 carried on section 37C near the top thereof. Cable 42 has its opposite end entrained around a drum 44 mounted on a shaft 46 which is journaled in a member 47 carried by the support means 17. An eccentric locking brake 48 is also carried by member 47 and is manually operable by means of handle 49 for selectively locking drum 44 against rotation when the rack 38 is in the desired position relative to ceiling work area 15. A crank/wheel system may alternatively be employed for this purpose.

To facilitate movement of the apparatus on the floor between different positions, it is preferred to provide the vertical standard 37 with a pair of laterally extending angularly spaced outrigger frames 50 and 51 having floor engaging members 52 and 53 at their outer ends. As here shown, frame 50 is secured directly to lower member 37C of the vertical standard, and frame 51 is pivotally attached, as at 54 to standard member 37C in such manner that outrigger frame 51 can be moved to the position illustrated in FIG. 1 where frame 51 is angularly related to frame 50, frames 50 and 51 being releasably held in such position by an overcenter linkage 56.

Figure 4:
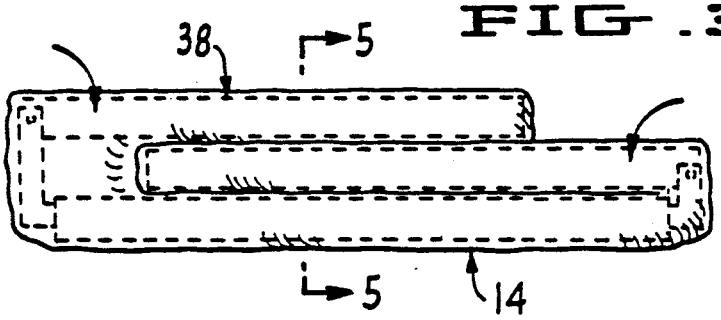
FIG. 4 is a view taken similarly to that of FIG. 3, but showing the apparatus in its folded flat condition.
Figure 5:
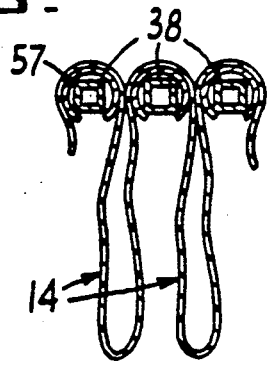
FIG. 5 is a vertical cross-sectional view taken substantially on the plane of line 5—5 of FIG. 4.

As may be seen in FIGS. 4 and 5 of the drawings, the rack 38 is also formed to fold flat for maneuvering and storage of the unit. The rack 38 is shown in open condition in FIG. 3 and in folded condition in FIGS. 4 and 5. Note that the rack 38 can be moved between folded and unfolded conditions while the bag 14 is still in place on the rack.

Experience has shown that unless the ceiling substrate is extremely stable, which is seldom the case, the act of urging the top 16 of the bag into contaot with the ceiling tends to dislodge asbestos fibers from the ceiling into the atmosphere. Where the ceiling substrate is relatively friable, it has generally been found best to keep the rack 38 approximately one to three inches below the ceiling 13. The evacuation means 32 is sufficiently powerful to keep fibers from escaping between the upper end 16 of the containment bag 14 and the ceiling 13. Preferably, the negative air pressure should be used in combination with a surfactant containing water spray applied to the work surface. The arms of the rack 38 telescope to accomodate containment bags 14 of different sizes. The rack 38 can be made to adjust to various angle settings for the purpose of accomodating work on vaulted or pitched-type ceiling surfaces.

Figure 2:
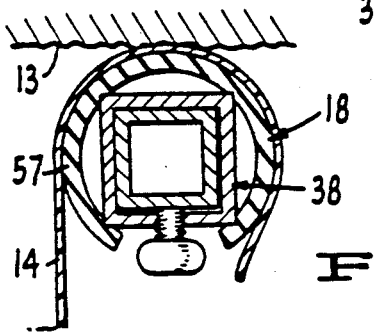
FIG. 2 is a vertical cross-sectional view on an enlarged scale taken substantially on the plane of line 2—2 of FIG. 1.

A cushion covering 18 is provided on rack 38 in the form of a flexible, semi-tubular resilient member 57 mounted on each of the straight members of rack 38, see FIG. 2 of the drawing to prevent injury to bag 14 or ceiling 18. Where the ceiling substrate is sufficiently stable, forcing the rack 38 gently upwardly tends to compress the portion of members 57 between the rack and the ceiling 13 to further aid in effecting a seal.

For further control of the asbestos fibers 12 within the containment bag 14, a tank 58 is removably mounted by means of a member 59 on the lower vertical standard member 37C. A manually operable stirrup pump 61 is mounted in the upper end of the tank 58 and is formed for pumping amended water or the like from tank 58 through a flexible hose 62 to the interior of the containment bag 14. Preferably, a spray nozzle 63 is mounted on the end of hose 62 to spray into containment bag 14, where it can be used for settling the asbestos fibers 12.

Figure 7:
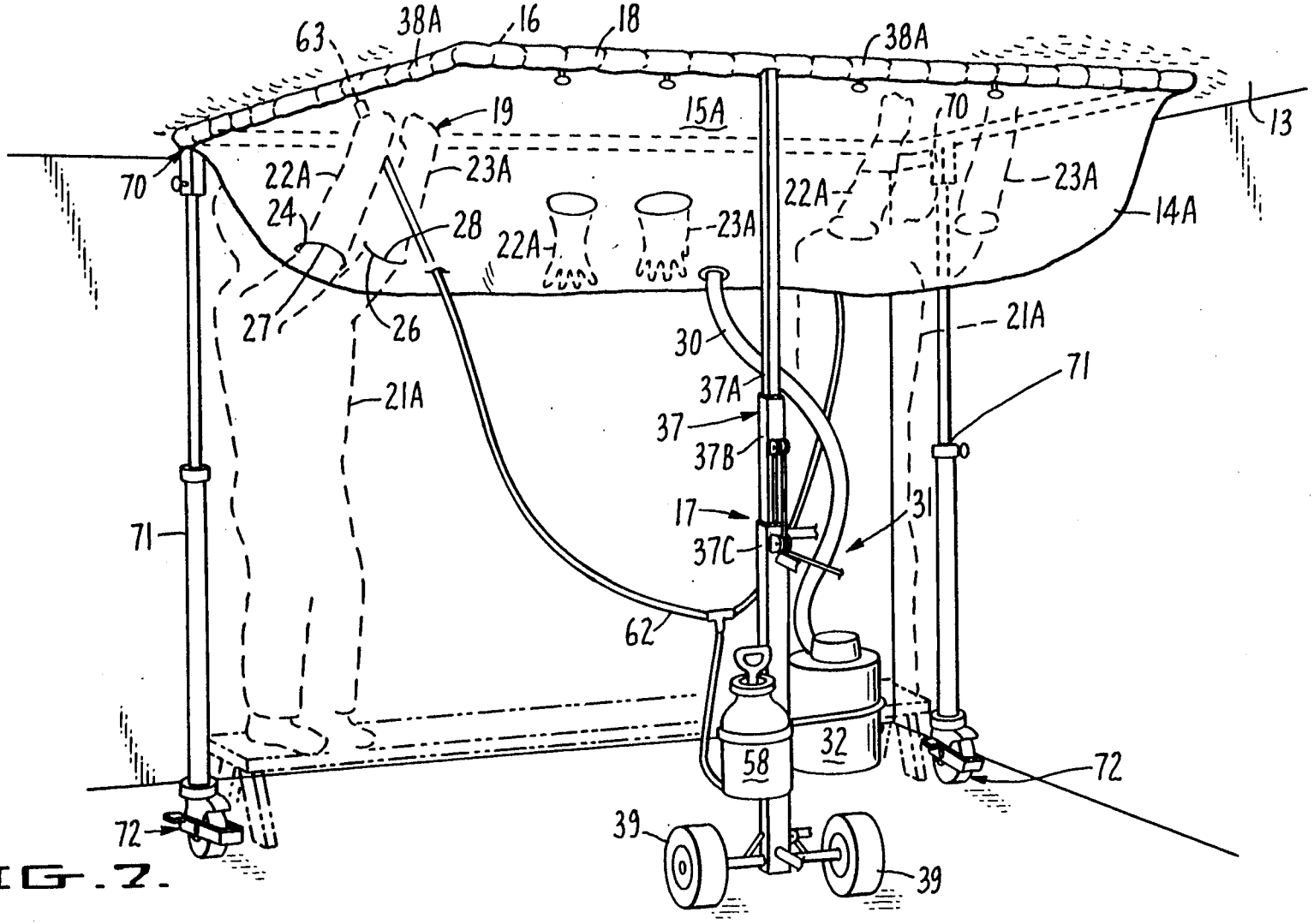
FIG. 7 is a perspective view of a modified form of the apparatus of FIG. 1.

In the form of the invention shown in FIG. 7 of the drawings, the containment llA utilizes an asbestos fibertight bag l4A and supporting rack 38A which are similar to but much larger in their horizontal dimensions than bag 14 and rack 38 of FIG. 1 so as to extend over a much lar9er horizontal area 15A of the ceiling 13. The larger size of the containment bag 14A makes it possible for a plurality of workers 2lA to work together side by side on the ceiling at the same time. For this purpose, additional pairs of gloves 22A and 23A are formed in spaced relation along the bag 14A.

Figure 8:
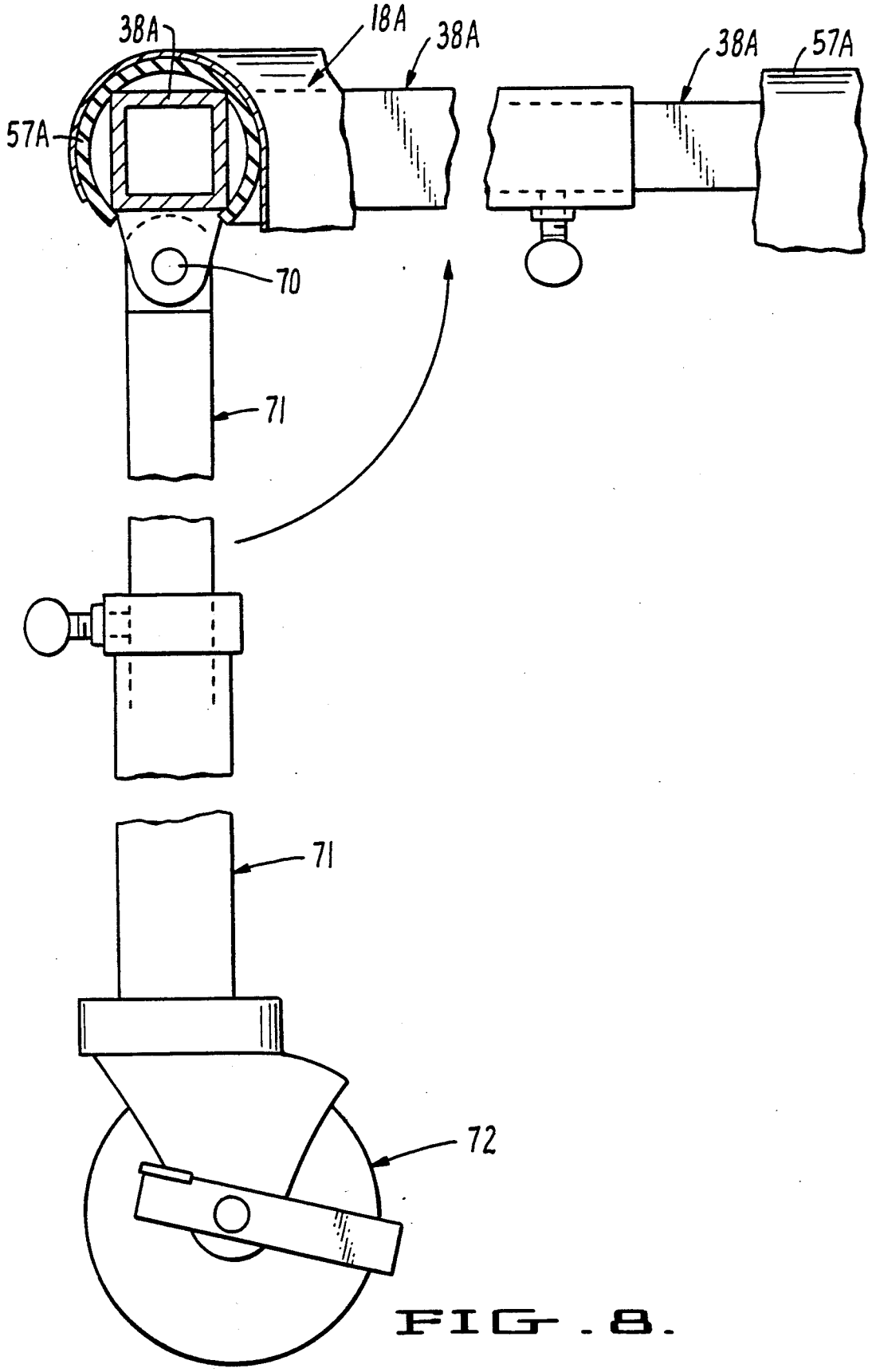
FIG. 8 is an enlarged side elevational view of an auxiliary leg and associated portion of a containment bag support frame, with portions broken away and shown in section for clarity.

The larger size of containment 11A results in greater weight and an increased tendency to tip over, which is exacerbated by the unbalanced lateral forces on the containment 11A exerted by the multiple users. As shown in FIGS. 7 and 8 of the drawings, one or more telescoping auxiliary legs 71 are pivotally secured at their upper ends 70 to the rack 38A and can be extended downwardly to the floor to provide the desired support. Preferably, lockable swivel wheels 72 are carried at the lower ends of the auxiliary legs 71 to permit precise lateral repositioning of the containment 11A without having to retract the auxiliary legs 71.

It will therefore be seen that the containment apparatus of the present invention is particularly well suited for confining and removing asbestos fibers and the like which are floating in the air adjacent to a ceiling work area, in which work is being done upon asbestos containing material on the ceiling on other structures near the ceiling, without danger to the user and without unnecessarily obstructing the space beneath the work area.

What is claimed is:

1. A containment for asbestos fibers and the like floating in the air adjacent to a ceiling as a consequence of removing or repairing materials on or near the ceiling, comprising a substantially fiber tight bag of flexible material having an open top adapted for placement in a position fitting in close proximity to a ceiling in surrounding relation to the ceiling area to be worked upon;

support means formed for removably holding said bag in the desired position relative to said ceiling;

sealing means on said open top of said bag adapted for cooperating with said ceiling to confine asbestos fibers;

glove means of flexible material sealed to said bag and adapted for providing protected access to the interior of said bag for the hands and arms of users;

the major portion of said bag being substantially transparent whereby a user having a hand inserted in said glove means can view the area of the ceiling being worked upon from outside said bag, said bag being formed of transparent flexible sheet plastic, said glove means comprising a plurality of pairs of flexible gloves sealed in laterally spaced relation to openings through said bag in position to accommodate simultaneously the hands and forearms of a plurality of users.

2. A containment as described in claim 1, and wherein said support means provides a telescoping substantially vertical standard having a horizontally extending rack on its upper end formed for receiving the upper edge of said flexible bag, and a telescoping auxiliary leg is secured to said rack and extends downwardly therefrom to the floor for assisting in supporting and steadying said rack and said bag.

3. A containment as described in claim 2, and wherein a floor engaging swivel wheel is mounted on the lower end of said auxiliary leg.

* * * * *